US008511282B2

(12) United States Patent
Jang

(10) Patent No.: US 8,511,282 B2
(45) Date of Patent: Aug. 20, 2013

(54) MOUNTING STRUCTURE OF HIGH PRESSURE FUEL PUMP FOR GASOLINE DIRECT INJECTION ENGINE

(75) Inventor: Sungkweon Jang, Seoul (KR)

(73) Assignee: Hyundai Motor Company, Seoul (KR)

( * ) Notice: Subject to any disclaimer, the term of this patent is extended or adjusted under 35 U.S.C. 154(b) by 294 days.

(21) Appl. No.: 12/949,199

(22) Filed: Nov. 18, 2010

(65) Prior Publication Data

US 2012/0073547 A1 Mar. 29, 2012

(30) Foreign Application Priority Data

Sep. 29, 2010 (KR) ..... 10-2010-0094803

(51) Int. Cl.
*F02M 37/04* (2006.01)

(52) U.S. Cl.
USPC ..... 123/509; 123/198 R; 123/198 C

(58) Field of Classification Search
USPC ..... 123/509, 198 R, 198 C, 195 A, 90.27, 123/90.33; 417/231, 423.15; 184/6.28
See application file for complete search history.

(56) References Cited

U.S. PATENT DOCUMENTS

| | | | | |
|---|---|---|---|---|
| 4,476,836 | A * | 10/1984 | Enomoto et al. | 123/502 |
| 6,148,787 | A * | 11/2000 | Takano | 123/195 A |
| 6,170,471 | B1 * | 1/2001 | Yonezawa et al. | 123/508 |
| 8,069,843 | B2 * | 12/2011 | Lee | 123/508 |
| 8,127,747 | B2 * | 3/2012 | Ahn | 123/508 |
| 8,166,954 | B2 * | 5/2012 | Park | 123/508 |
| 8,307,799 | B2 * | 11/2012 | Shin | 123/90.33 |
| 2007/0227509 | A1 * | 10/2007 | Ueda et al. | 123/509 |
| 2010/0071655 | A1 * | 3/2010 | Kim | 123/196 R |
| 2011/0126793 | A1 * | 6/2011 | Ahn | 123/196 R |

FOREIGN PATENT DOCUMENTS

| | | | |
|---|---|---|---|
| JP | 2001-73733 | A | 3/2001 |
| JP | 2002-061549 | A | 2/2002 |
| JP | 2004-28079 | A | 1/2004 |
| JP | 2004-225536 | A | 8/2004 |
| JP | 2009-228615 | A | 10/2009 |
| KR | 10-2009-0121448 | A | 11/2009 |
| KR | 10-2010-0034889 | A | 4/2010 |

* cited by examiner

*Primary Examiner* — Stephen K Cronin
*Assistant Examiner* — Elizabeth Hadley
(74) *Attorney, Agent, or Firm* — Morgan, Lewis & Bockius LLP

(57) ABSTRACT

A mounting structure of a high pressure fuel pump for a gasoline direct injection engine, wherein a cam carrier may be mounted on top of a cylinder head and the high pressure fuel pump may be directly attached to an outer side of the cam carrier.

5 Claims, 6 Drawing Sheets

MOUNTING STRUCTURE OF HIGH PRESSURE FUEL PUMP FOR GASOLINE DIRECT INJECTION ENGINE

CROSS-REFERENCE TO RELATED APPLICATIONS

The present application claims priority to Korean Patent Application Number 10-2010-0094803 filed Sep. 29, 2010, the entire contents of which application is incorporated herein for all purposes by this reference.

BACKGROUND OF THE INVENTION

1. Field of the Invention

The present invention relates to a mounting structure of a high pressure fuel pump for a gasoline direct injection engine, and more particularly, to a high pressure fuel pump for a gasoline direct injection engine which is equipped with a high pressure fuel pump on the outer side of a cam carrier.

2. Description of Related Art

In general, gasoline direct injection engines that directly inject gasoline into the combustion chamber, using a injector, need a high pressure pump to increase the low pressure (about 4 bar) of fuel supplied from a fuel tank to high pressure (about 150-200 bar).

In the related art, a high pressure fuel pump 1 was directly fastened to a cylinder head cover 2, as shown in FIG. 1, or an adaptor, which is a separate part, was mounted on cylinder head cover 2 and high pressure fuel pump 1 was combined with the adaptor.

Further, in the structure having high pressure fuel pump 1 mounted on cylinder head cover 2, as described above, high pressure fuel pump 1 protruded vertically from the top of cylinder head cover 2.

However, that structure mounting high pressure fuel pump 1 had a problem that high pressure fuel pump 1 vertically protrudes upward from the top of cylinder head cover 2, entire height of the engine room increases and accordingly this is disadvantageous in design and layout of the vehicle hood.

Further, the structure had a problem that when high pressure fuel pump 1 is mounted on cylinder head cover 2, the space inside cylinder head cover 2 is reduced by high pressure fuel pump 1 and accordingly it becomes difficult to dispose baffles for forming a blow-by gas ventilation system inside cylinder head cover 2.

In particular, in a two-cylinder engine, when high pressure fuel pump 1 is mounted on cylinder head cover 2, it is impossible to disposed baffles inside cylinder head cover 2.

Further, high pressure fuel pump 1 includes tappets, such as roller and pistons which are operated by power transmitted through a cam and the tappets should be lubricated for smooth operation, such that oil for lubrication is supplied from the cylinder head.

However, when high pressure fuel pump 1 is mounted on cylinder head cover 2, as in the related art, the oil line for supplying oil from the cylinder head is elongated, and as the oil line is elongated, it is difficult to form the oil line and a problem may occur in sealing.

Further, when high pressure fuel pump 1 is mounted by an adaptor, which is a separate part, the cost and weight increase and the assembly cycle increases, such that it is disadvantageous in terms of productivity.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a mounting structure of a high pressure fuel pump for a gasoline direct injection engine that is advantageous in terms of design and layout of a vehicle hood, because the entire height is reduced by directly attaching a high pressure fuel pump to the outer side of a cam carrier, that makes it easy to disposing baffles for forming a blow-by gas ventilation system inside a cylinder head, that is advantageous in forming an oil line and improving sealablity by reducing the oil line from the cylinder head to the high pressure fuel pump, and that can reduce the manufacturing cost and weight.

In an aspect of the present invention, the mounting structure of a high pressure fuel pump for a gasoline direct injection engine, wherein a cam carrier may be mounted on top of a cylinder head and the high pressure fuel pump may be directly attached to an outer side of the cam carrier.

A pump-mounting surface may be formed on the outer side disposed in a side in which an intake port of the cylinder head may be disposed, and a housing flange of the high pressure fuel pump may be fastened to the pump-mounting surface by a plurality of fasteners.

The high pressure fuel pump may be fixed to the outer side disposed in a side in which an intake port of the cylinder head may be disposed, wherein the high pressure fuel pump may be attached to the outer side of the cam carrier such that an exhaust port of the high pressure fuel pump may be turned at a predetermined angle toward the intake port of the cylinder head in the side in which the intake port of the cylinder head may be disposed.

A housing member may be disposed under an injector and the intake port in the side in which the intake port of the cylinder head may be disposed and the exhaust port of the high pump fuel pump may be connected to the housing member mounted to the cylinder head.

An oil groove may be longitudinally formed in a cam journal of the cam carrier such that oil may be supplied from the cylinder head to the high pressure fuel pump, wherein one end of the oil groove may be connected with an oil hole connected with the cylinder head and the other end of the oil groove may be connected with an oil channel connected to the high pressure fuel pump, through the pump-mounting surface.

The oil groove formed in the cam journal may be closed and sealed from the outside by a cam cap combined with the cam journal.

According to the exemplary embodiment of the present invention, since a high pressure fuel pump is attached to a side with an intake port of a cylinder head, in the outer sides of a cam carrier, to be directly attached to the cylinder head, it is possible to improve design and layout of the vehicle hood, by largely reducing the entire height of the engine room, easily dispose baffles for forming a blow-by gas ventilation system inside the cylinder head cover, reduce the weight and the manufacturing cost, by minimizing movement distance of fuel from the high pressure fuel pump to injectors, easily form the oil line, by significantly reducing the oil line from the cylinder head to the high pressure fuel pump, maintain the oil pressure, and improve sealability.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
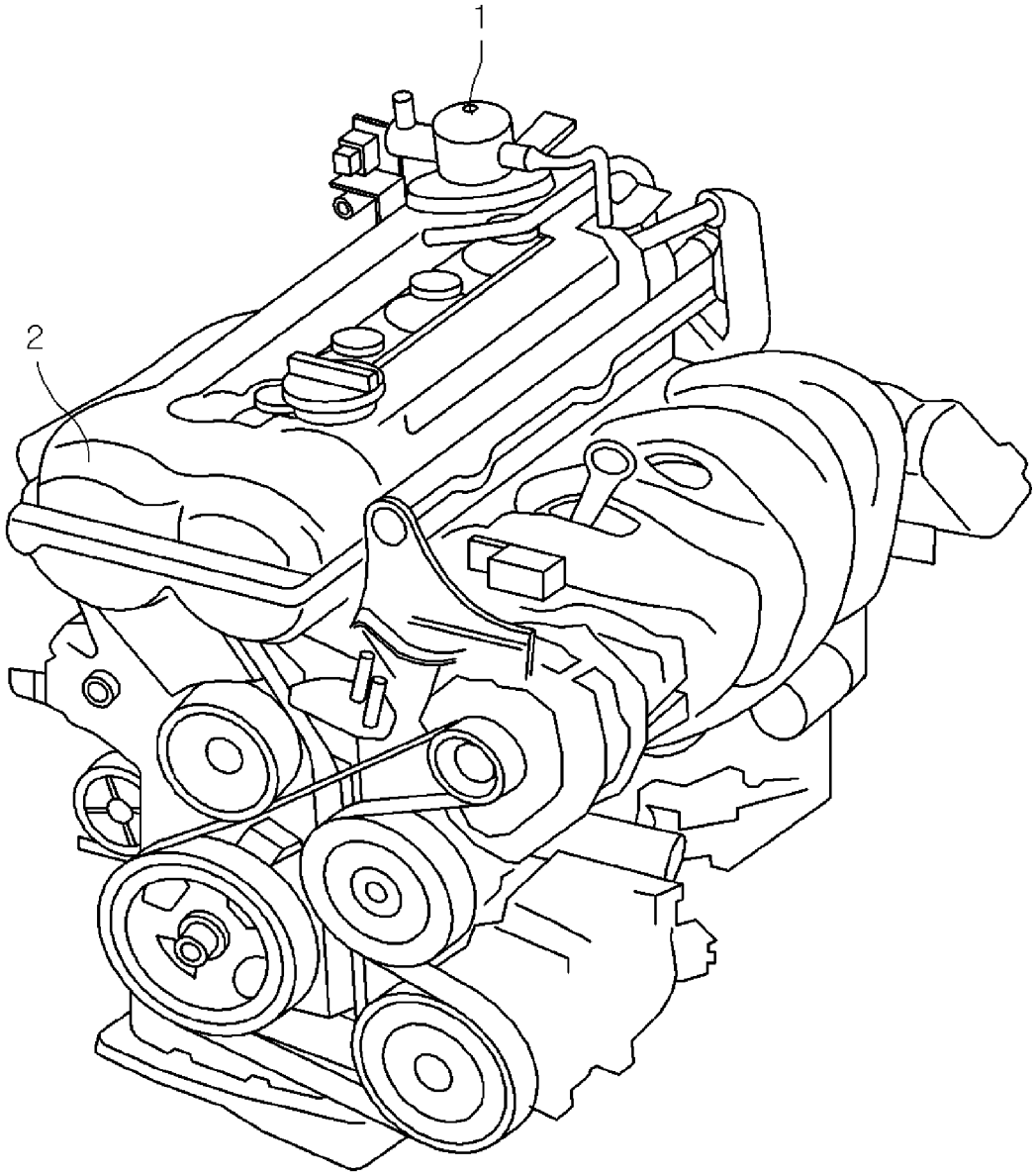
FIG.1 (Prior Art)
FIG. 1 is a view showing when a high pressure fuel pump is mounted on the top of a cylinder cover, according to a structure of the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 2:
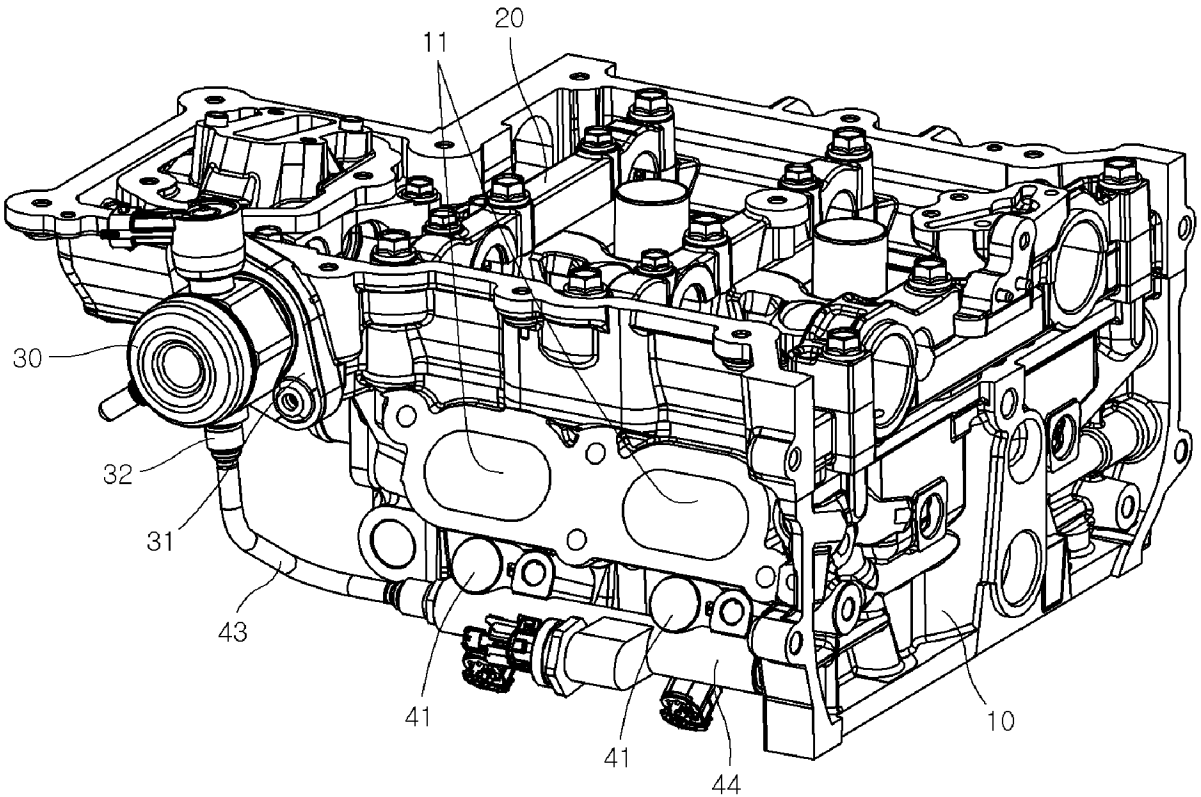
FIG. 2 is a view showing when a high pressure fuel pump is attached to a side of a cam carrier, according to an exemplary embodiment of the present invention.
Figure 3:
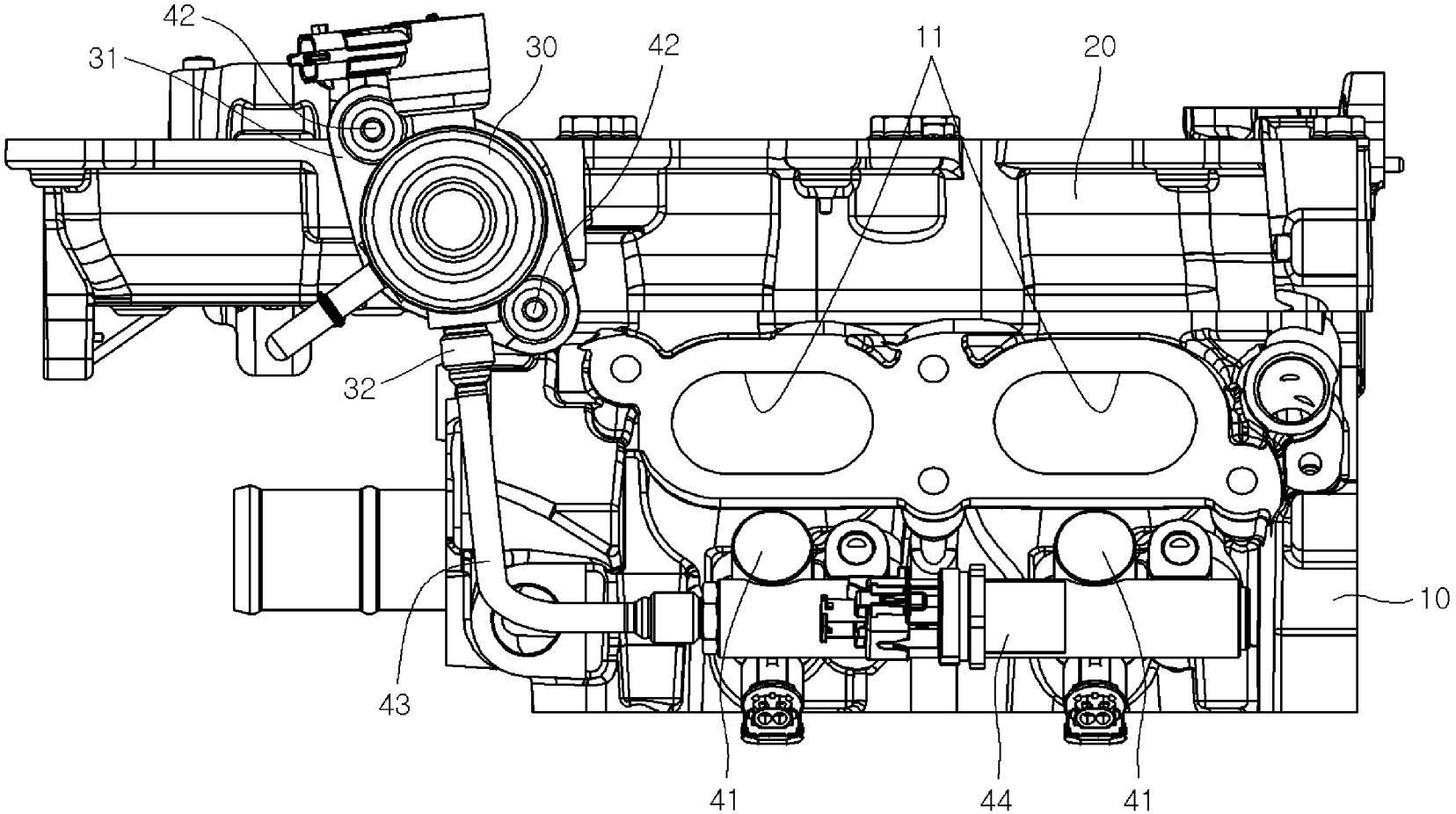
FIG. 3 is a view of the high pressure fuel pump seen from the front in FIG. 2.
Figure 4:
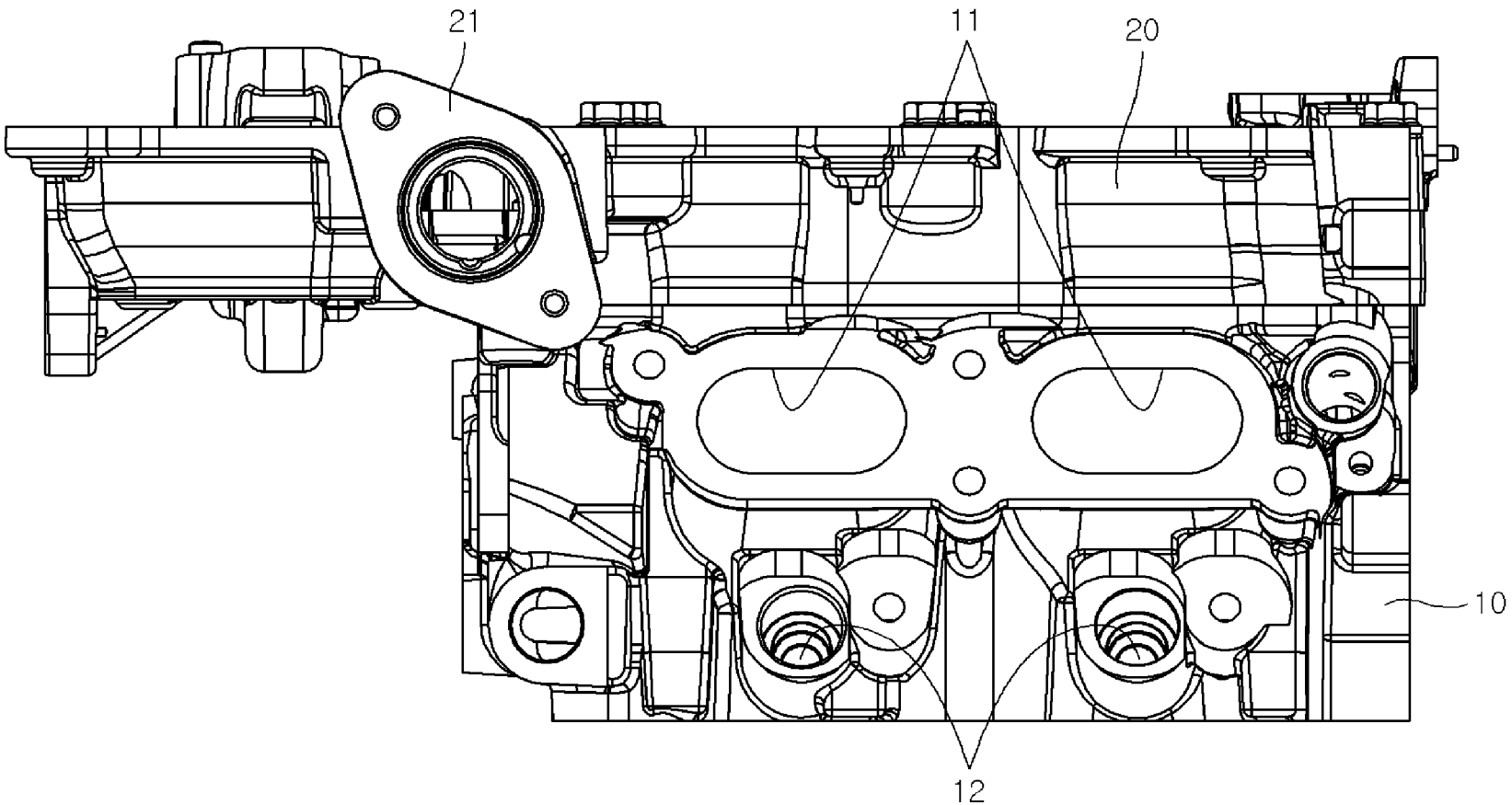
FIG. 4 is a view showing a pump-mounting surface of the cam carrier with the high pressure fuel pump removed in FIG. 3.
Figure 5:
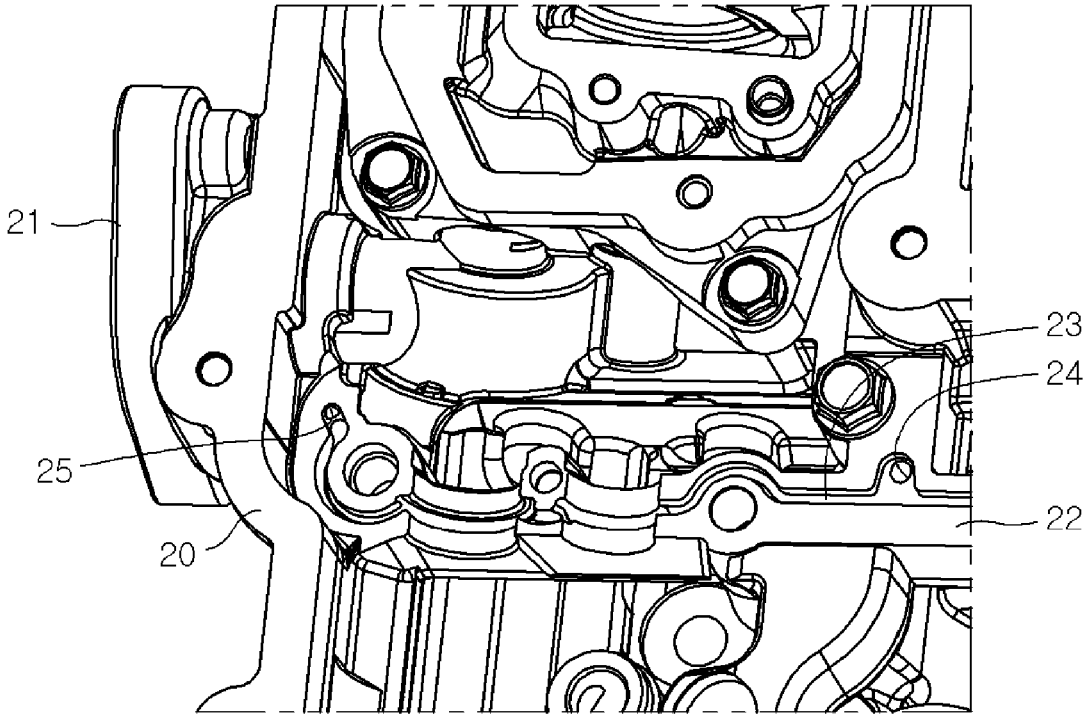
FIGS. 5 and 6 are views showing an oil path formed in the cam carrier.
Figure 5:
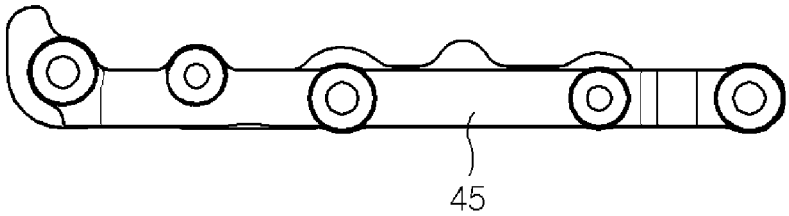
Figure 6:
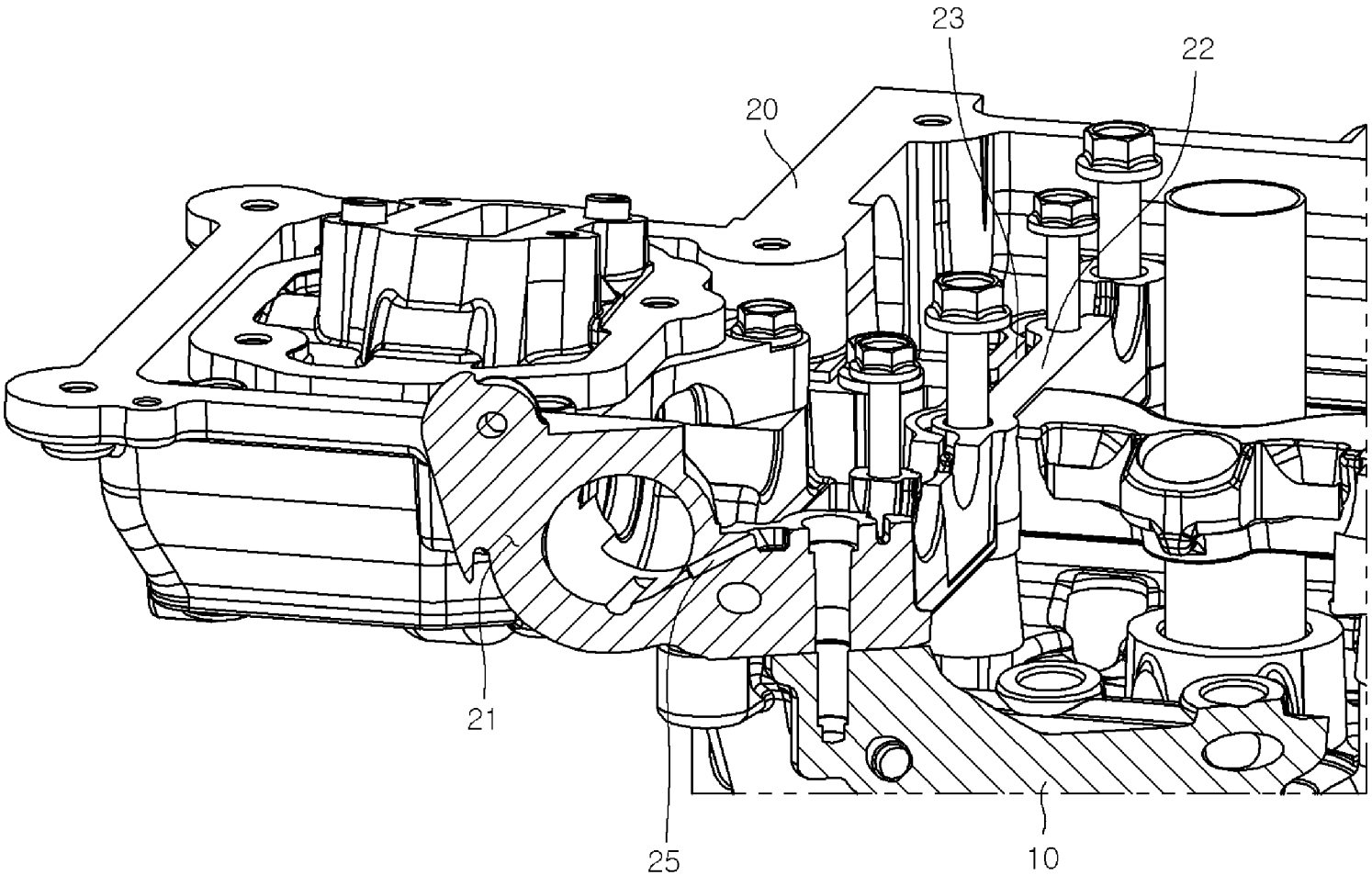

As shown in FIGS. 2 to 6, a cam carrier 20 is mounted on the top of a cylinder head 10 and a high pressure fuel pump 30 is directly attached to an outer side of cam carrier 20.

In this structure, cylinder head 10 has an intake port 11 at one side and an exhaust port at the other side and injector holes 12 are formed around (under in the figures) intake port 11 to dispose injectors 41.

High pressure fuel pump 30 is fixed to the side with intake port 11 of cylinder head 10, in the outer sides of cam carrier 20, according to an exemplary embodiment of the present invention. In more detail, a pump-mounting surface 21 is formed on any one side with intake port 11 of cylinder head 10, in the outer sides of cam carrier 20, and a housing flange 31 of high pressure fuel pump 30 is fastened to pump-mounting surface 21 by a plurality of fasteners 42.

Fasteners 42 may be common bolts, but are not limited thereto.

Further, it is preferable to attach high pressure fuel pump 30 to the outer side of cam carrier 20 such that an exhaust port 32 of high pressure fuel pump 30 turns at a predetermined angle toward intake port 11 of cylinder head 10, in order to minimize the movement distance of fuel from high pressure fuel pump 30 to injectors 41.

That is, the farther the exhaust port 32 of high pressure fuel pump 30 from intake port 11 of cylinder head 10, the more the movement distance of fuel from high pressure fuel pump 30 to injectors 41 increases, which causes problems, for example, increase of weight and manufacturing cost.

Therefore, according to an exemplary embodiment of the present invention, high pressure fuel pump 30 is disposed with exhaust port 32 turned at a predetermined angle toward intake port 11.

One end of a fuel pipe 43 is connected to exhaust port 32 of high pressure fuel pump 30 and the other end of fuel pipe 43 is connected to a housing member 44 to keep the fuel under high pressure, in which housing member 44 is combined with cylinder head 10 across injector holes 12 and injectors 41 are connected with housing member 44.

High pressure fuel pump 30 includes tappets, such as roller and pistons which are operated by power transmitted through a cam and the tappets should be lubricated for smooth operation, such that the present invention has a structure supplying oil for lubrication from cylinder head 10 to high pressure fuel pump 30.

That is, an oil groove 23 is formed longitudinally in a cam journal 22 of cam carrier 20 such that the oil can be supplied from cylinder head 10 to high pressure fuel pump 30, one end of oil groove 23 is connected to oil hole 24 connected to cylinder head 10 and other end of oil groove 23 is connected with an oil channel 25 connected to high pressure fuel pump 30 through pump-mounting surface 21.

Oil groove 23 is open upward, such that the opening should be sealed from the outside, and for this configuration, the present invention uses a cam cap 45 combined with cam journal 22.

As described above, since high pressure fuel pump 30 is attached to the outer side of cam carrier 20 and high pressure fuel pump 30 does not protrude upward from the cylinder head cover, as in the related art, the entire height of the engine room can be considerably reduced and accordingly the present invention becomes advantageous in improving design and layout of the vehicle hood.

Further, since high pressure fuel pump 30 is attached to the side of cam carrier 20, the present invention has the advantage of preventing the space inside the cylinder cover from decreasing due to high pressure fuel pump 30 and easily disposing baffles for forming a blow-by gas ventilation system inside the cylinder head cover.

Further, since high pressure fuel pump 30 is attached to the side with intake port 11 of cylinder head 10 in the sides of cam carrier 20 and exhaust port 32 of high pressure fuel pump 30 is turned at a predetermined angle toward intake port 11, the movement distance of fuel from high pressure fuel pump 30 to injectors 41 can be minimized, and accordingly, the present invention has the advantage of reducing the weight and the manufacturing cost and supplying fuel more stably to injectors 41.

Further, when high pressure fuel pump 30 is attached to the side of cam carrier 20 in accordance with the present invention, the oil line for receiving oil from the cylinder head can be significantly reduced, as compared with when the high pressure fuel pump is mounted on the top of the cylinder head in the related art. Accordingly, the structure according to an exemplary embodiment of the present invention is advantageous in forming the oil line, maintaining the oil pressure, and improving sealability.

Further, since high pressure fuel pump 30 is directly attached to cam carrier 20 without a specific assistant member, the present invention has the advantage of reducing the number of parts, the manufacturing cost, and the weight and improving productivity by reducing the assembly cycle, in comparison to the structures using a specific assistant member, such as an adaptor, in the related art.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A mounting structure of a high pressure fuel pump for a gasoline direct injection engine, wherein a cam carrier is mounted on top of a cylinder head and the high pressure fuel pump is directly attached to an outer side of the cam carrier;

wherein a pump-mounting surface is formed on the outer side disposed in a side in which an intake port of the cylinder head is disposed;

wherein a housing flange of the high pressure fuel pump is fastened to the pump-mounting surface by a plurality of fasteners;

wherein an oil groove is longitudinally formed in a cam journal of the cam carrier such that oil is supplied from the cylinder head to the high pressure fuel pump; and wherein one end of the oil groove is connected with an oil hole connected with the cylinder head and the other end of the oil groove is connected with an oil channel formed in the pump-mounting surface of the cam carrier and connected to the high pressure fuel pump.

2. The mounting structure of the high pressure fuel pump for the gasoline direct injection engine as defined in claim 1, wherein the high pressure fuel pump is fixed to the outer side disposed in a side in which an intake port of the cylinder head is disposed.

3. The mounting structure of the high pressure fuel pump for the gasoline direct injection engine as defined in claim 2, wherein the high pressure fuel pump is attached to the outer side of the cam carrier such that an exhaust port of the high pressure fuel pump is turned at a predetermined angle toward the intake port of the cylinder head in the side in which the intake port of the cylinder head is disposed.

4. The mounting structure of the high pressure fuel pump for the gasoline direct injection engine as defined in claim 2, wherein a housing member is disposed under an injector and the intake port in the side in which the intake port of the cylinder head is disposed and the exhaust port of the high pressure fuel pump is connected to the housing member mounted to the cylinder head.

5. The mounting structure of the high pressure fuel pump for the gasoline direct injection engine as defined in claim 1, wherein the oil groove formed in the cam journal is closed and sealed from the outside by a cam cap combined with the cam journal.

* * * * *